United States Patent [19]

Kesten et al.

[11] Patent Number: 4,613,321

[45] Date of Patent: Sep. 23, 1986

[54] DIECUTTING ROLL SYSTEM WITH IMPROVED SCRAP DISPOSAL CAPABILITY

[75] Inventors: Martin Kesten, West Hartford; Leroy H. Carlson, Jr., Portland; Gary L. Kwader, Windsor, all of Conn.

[73] Assignee: Preston Engravers, Inc., Windsor, Conn.

[21] Appl. No.: 773,015

[22] Filed: Sep. 6, 1985

[51] Int. Cl.[4] ..... B31B 1/24

[52] U.S. Cl. ..... 493/342; 83/49; 83/105; 83/303; 493/373

[58] Field of Search ..... 493/373, 342, 83, 82, 493/905, 919, 925, 935; 83/105, 102, 48, 49, 303, 113, 121, 122, 145, 146, 148, 41

[56] References Cited

U.S. PATENT DOCUMENTS

| | | | |
|---|---|---|---|
| 412,618 | 10/1889 | Holz . | |
| 642,220 | 1/1900 | Green . | |
| 705,040 | 7/1902 | Copland . | |
| 799,624 | 9/1905 | Beck et al. . | |
| 1,825,250 | 9/1931 | Rehak . | |
| 2,143,209 | 1/1939 | Rambold . | |
| 2,386,147 | 10/1945 | Sidebotham . | |
| 2,805,857 | 9/1957 | Policansky | 83/121 X |
| 3,106,121 | 10/1963 | Novick . | |
| 3,174,428 | 3/1965 | Huck . | |
| 3,194,095 | 7/1965 | Buck et al. . | |
| 3,380,327 | 4/1968 | Stemmler . | |
| 3,404,607 | 10/1968 | Feick et al. . | |
| 3,602,080 | 10/1971 | Sickel . | |
| 3,680,419 | 9/1972 | Stoop . | |
| 3,698,271 | 10/1972 | Kesten et al. . | |
| 3,698,272 | 10/1972 | Kesten et al. . | |
| 3,766,814 | 10/1973 | Kesten . | |
| 3,807,610 | 4/1974 | Mueller, Jr. . | |
| 3,872,752 | 3/1975 | Remde et al. . | |
| 3,949,653 | 4/1976 | Schroter . | |
| 3,956,974 | 5/1976 | Schroter . | |
| 4,037,501 | 7/1977 | Gladow . | |
| 4,108,343 | 8/1978 | Vossen . | |
| 4,109,842 | 8/1978 | Aquilla | 493/373 X |
| 4,191,077 | 3/1980 | Edwards et al. . | |
| 4,220,272 | 9/1980 | Danti . | |
| 4,276,800 | 7/1981 | Koppa et al. . | |
| 4,305,716 | 12/1981 | Nickum | 493/373 X |
| 4,452,595 | 6/1984 | Huff . | |

*Primary Examiner*—James F. Coan

[57] ABSTRACT

A tandem arrangement of diecutting rolls severs scrap from a traveling web in two steps, each of which steps effects cutting entirely through the web, but at different peripheral locations. The partially cut scrap is carried with the remainder of the web from the first roll to the second, and any severed piece that lodges within the cutting element of the second roll is removed by the action of a mechanical scraper, which passes therethrough.

10 Claims, 3 Drawing Figures

DIECUTTING ROLL SYSTEM WITH IMPROVED SCRAP DISPOSAL CAPABILITY

BACKGROUND OF THE INVENTION

In the manufacture of labels, tags, tickets and the like, it is now common practice to carry out at least part of the conversion operations with a diecutting roll, acting upon traveling web stock. This is done, for example, to cut holes or slots of various shapes in the web, or to form fastener openings, corners or necked-in areas in the finished article. However, serious problems must be dealt with in carrying out such operations, which arise primarily as a result of the accumulation of scrap material within the die element, and/or the inefficient removal of the scrap from the web.

As will be readily appreciated, by cutting through the entire thickness of the web stock the scrap can normally be stripped away, simply by virtue of its frictional engagement within the die cavity. In the absence of some provision for removing the scrap from the cavity, however, accumulations therein will quickly render the roll ineffective, and may often cause severe damage, such as bursting of the die formations provided thereon. These problems tend to be particularly acute when the web stock is printed or carries an adhesive coating.

Diecutting rolls are disclosed in the art which utilize positive and/or negative air pressure to efficiently remove scrap pieces from the cutting element. An assembly that is particularly effective, which operates on an air-ejection principle, is described and claimed in Kesten et al U.S. Pat. No. 3,698,271. A suction unit is taught by Buck et al, in U.S. Pat. No. 3,194,095, for continuously withdrawing confetti produced in the manufacture of indexing holes in paper forms, using a pair of rotating punch dies; and a "push-pull" chip removal system is disclosed by Stoop, in U.S. Pat. No. 3,680,419.

Although highly desirable in many applications, apparatus that relies upon air pressure to remove and control the disposition of scrap is not ideal in all instances. Pneumatic effects are simply not as positive as might always be desired for effecting the discharge of scrap from a die, and there is of course a certain amount of complexity involved in the associated air-delivery system.

It is also common practice to rely upon mechanical means to assist in the stripping of scrap from web stock. In the apparatus of Huck U.S. Pat. No. 3,174,428, for example, the perforating pins of a male die cylinder enter related die holes of a female cylinder. Similarly, in accordance with Danti U.S. Pat. No. 4,220,272, the apparatus provided includes a break-out punch, for removing precut scrap pieces, which intersects the scrap-removal path; at the upstream scoring station, rolls with precisely aligned punches are used to cut partially through the thickness of the web from both sides, leaving a weak section about the entire periphery of the scrap piece by which it is carried to the knock-out station.

Systems have heretofore been made available commercially which consist of two diecutting rolls operated in tandem to produce openings in traveling web stock; i.e., each die cuts only a portion of the periphery, with the complete score being made by coaction of the pair. The air-eject principle of the above-identified Kesten et al patent was used in one instance to effect removal of scrap from the downstream roll.

Despite the activity in the art exemplified by the foregoing, a demand nevertheless remains for a system by which disposal of scrap pieces, produced by rotary diecutting of web stock, can be achieved in a positive, highly reliable, and yet relatively simple manner.

Accordingly, it is the broad object of the present invention to provide a novel system of tandem diecutting rolls for producing openings in traveling web stock, in which disposal of the scrap generated is achieved in a highly effective and efficient manner.

It is a more specific object of the invention to provide such a system in which the scrap is mechanically removed from the die formations of the final cutting roll, positively and with a high degree of reliability.

Corresponding broad and specific objects concern the provision of a novel diecutting press and novel method, incorporating the foregoing system and the mode of operation that it affords.

Additional objects of the invention are to provide such a system, press and method, which are relatively uncomplicated, economical, and facile to use and to carry out.

SUMMARY OF THE INVENTION

It has now been found that certain of the foregoing and related objects of the invention are attained by the provision of a system comprising, in combination, first and second diecutting rolls adapted for journaling in a diecutting press, and a scraper member adapted for mounting thereon. Each of the rolls has at least one raised cutting element on its outer surface, the cutting elements of the two rolls being configured for coaction to provide a functionally continuous edge configuration for cutting a scrap piece from the web by acting sequentially thereupon, when the rolls are operated in tandem and in proper registry with one another. The cutting element of the second roll defines a circumscribed space within which the cut scrap piece will tend to lodge, and is discontinuous at least at two opposing points aligned circumferentially on the roll. The cutting element of the first roll is configured to precut the web at locations corresponding to the points of discontinuity of the second roll cutting element, and is discontinuous at least at one point which is displaced, with reference to the functionally continuous edge configuration, from the points of discontinuity of the second roll cutting element, so as to leave a connecting web element for subsequent severance by the cutting element of the second roll. The scraper member has an end portion which is constructed to follow the surface of the second roll, and to pass through the points of discontinuity and the circumscribed space of the cutting element thereof. Thus, the rolls can be mounted in tandem on a press and caused to operate sequentially upon a web traveling through it, to cooperatively cut a scrap piece from the web, and the scraper member can be mounted adjacent the second roll, with its end portion disposed against the surface and in alignment with the discontinuities of the cutting element thereof, to pass through the circumscribed space during rotation of the roll and to thereby dislodge any scrap piece held therewithin.

In the preferred embodiments, the second diecutting roll will have a circumferential groove formed in its surface and aligned with the discontinuities of the cutting element thereof, the groove being adapted to engage the end portion of the scraper member against lateral displacement and to guide it to and from the circumscribed space within the cutting element during rotation of the roll. Generally, both of the diecutting rolls will have second raised cutting elements on their outer surfaces, spaced axially from the "one" cutting elements thereof, the "second" cutting elements being disposed and configured for coaction to provide a second functionally continuous edge configuration to adapt the system to cut two openings in the web at transversely spaced locations thereacross. In a specific form of the system, the cutting elements of both of the rolls may define die formations of oblong configuration, the axes of elongation thereof being perpendicular to one another and the functionally continuous edge configuration thereby provided being substantially cruciform. Even more particularly, the cutting elements may desirably provide die formations of substantially elliptical configuration, with the first roll formation having two points of discontinuity and with the points of discontinuity of both of the formations being disposed on the minor axes of the ellipses.

The scraper member used in the system will advantageously comprise an elongated mounting bracket adapted for attachment to the press to extend parallel to the axis of rotation of the second roll. The bracket will have means for adjustably affixing a scraper piece at each of a multiplicity of locations along its length to act upon the second roll at corresponding locations along the length thereof, the scraper piece including a projecting finger which provides the roll-engaging end portion thereof.

Other objects of the invention are attained by the provision of a press including a frame and a diecutting station, the latter being comprised of first and second diecutting rolls journaled in the frame in tandem relationship, and at least one anvil roll journaled in the frame for cooperation with the diecutting rolls for cutting of a web material passing therebetween. The press will also include a scraper member mounted in the frame adjacent the second diecutting roll, means for continuously feeding web material through the diecutting station to proceed from the first to the second diecutting roll, and means for synchronously driving the rolls with the cutting elements thereof in registry with one another. The construction of the diecutting rolls and of the scraper member will be as hereinbefore described.

In certain embodiments of the press a second anvil roll will be included. In those instances, the first-mentioned diecutting roll will be cooperatively paired with the "one" anvil roll at a first location of the diecutting station, and the second diecutting roll will be cooperatively paired with the second anvil roll at a second location of the station, downstream from the first along the path of movement of the web material.

Additional objects of the invention are attained by the provision of a method wherein a web of material is continuously transported through a cutting station comprised of first and second diecutting rolls arranged in tandem and having the features hereinbefore described. The cutting rolls are caused to rotate synchronously, with the cutting elements thereof in registry with one another, to act sequentially upon the web to cooperatively sever a scrap piece therefrom and to cut an opening therein; i.e., the first roll will precut the web at locations corresponding to the points of discontinuity of the second roll cutting element, and the second roll will cut the connecting web element left by the first roll, thereby completing the severance of the scrap piece. Finally, an end portion of a scraper member, disposed adjacent the second roll, will be passed through the points of discontinuity and the circumscribed space of the cutting element thereof, to dislodge any scrap piece held therewithin.

In the preferred embodiments of the method, the second roll will have a circumferential groove formed in its surface aligned with the discontinuities of the cutting element, as above described. The end portion of the scraper member will be urged into the groove, to guide it to and from the circumscribed space of the cutting element.

DETAILED DESCRIPTION OF THE ILLUSTRATED EMBODIMENTS

Figure 1:
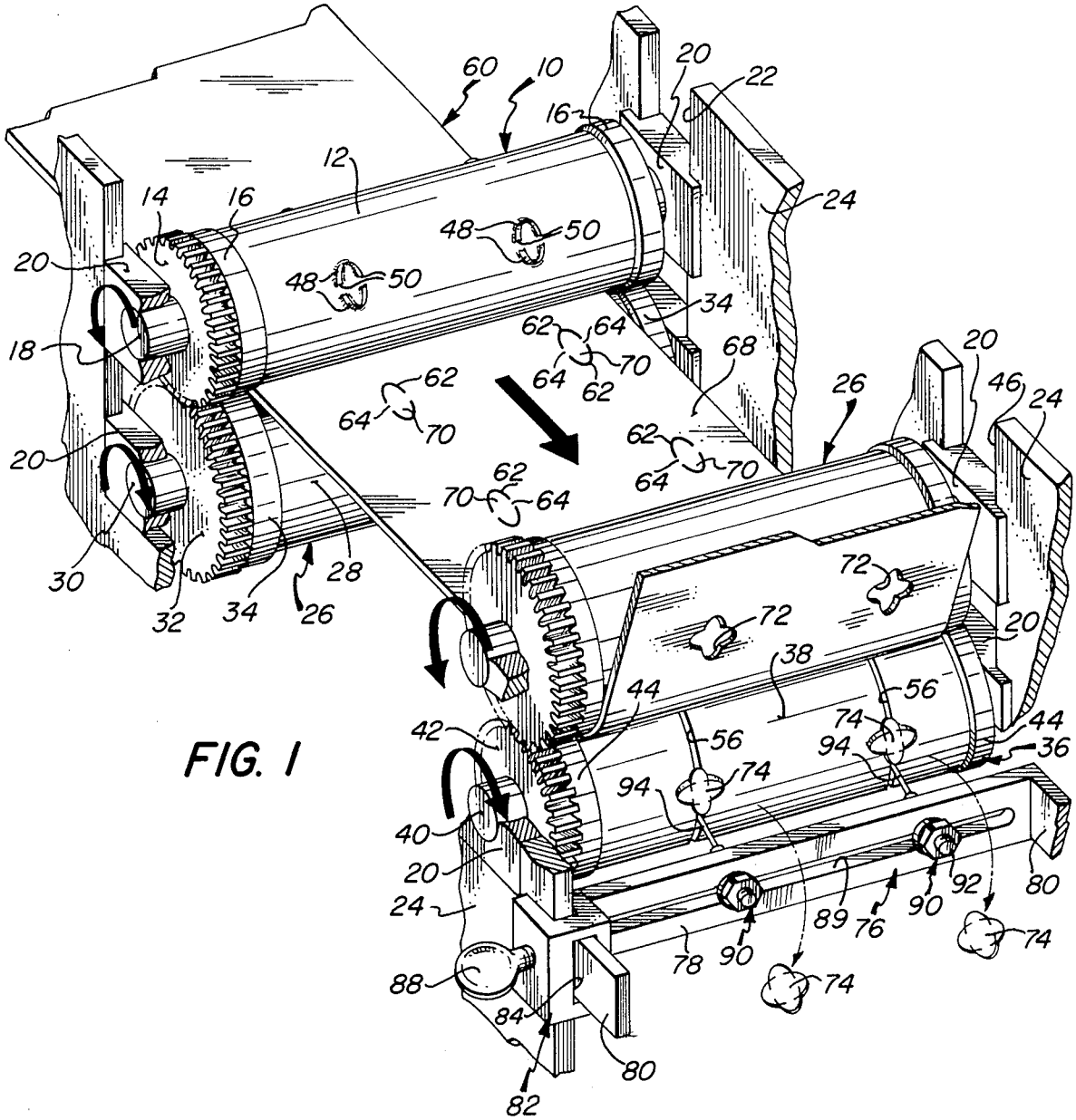
FIG. 1 is a schematic perspective view of a tandem roll diecutting system embodying the present invention, installed within the frame of a press, which is fragmentarily illustrated.

Turning initially to FIG. 1 of the drawings, therein illustrated is a tandem diecutting roll system embodying the present invention, providing a two-step cutting station. The upstream diecutting roll, generally designated by the numeral 10, is of conventional design, in a broad sense, and consists of a cylindrical body 12 to which a gear member 14 is rigidly affixed; annular bearer portions 16 are formed adjacent the opposite ends of the body, and shaft portions 18 extend coaxially therefrom. The shaft portions 18 are journaled in suitable bearing blocks 20 which are, in turn, slidably engaged within vertical slots 22 formed into the frame 24 of the press in which the system is installed.

The cutting roll 10 cooperates with an underlying anvil roll, generally designated by the numeral 26, which is also of conventional construction. It has a cylindrical body 28, with coaxial shaft portions 30, a gear member 32, and annular bearers 34. As can be seen, the gear members 14, 32 are in meshing engagement, for synchronous counterrotational driving (as indicated by the arrows) of the diecutting and anvil rolls 10, 26, and the corresponding bearers 16, 34 ride in direct contact with one another, in conventional manner.

The downstream cutting roll, generally designated by the numeral 36, is similarly constructed with a cylindrical body 38, coaxial shaft portions 40, a gear member 42, and bearers 44. It, together with a cooperating anvil roll 26, is mounted within the frame 24 by assemblying the rollers, in bearing blocks 20, within a second vertical slot 46; as will be noted, the relative positions of the diecutting roll 36 and anvil roll 26 are inverted from that of the upstream pair.

Each cutting die formation on the outer surface of the body 12 of the first roll 10 is comprised of two confronting, circumferentially aligned, generally U-shaped elements 48, which together form an elliptical figure. It will be noted that the ends of the U-shaped elements are spaced slightly from one another to provide two breaks or discontinuities at laterally (axially) spaced points 50.

Figure 2:
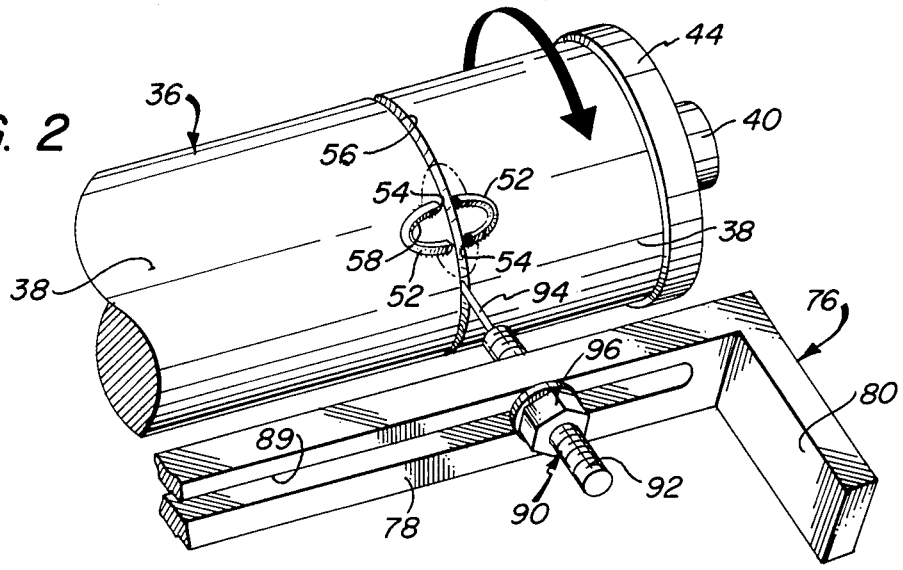
FIG. 2 is a fragmentary perspective view of the downstream diecutting roll and the scraper assembly employed in the system of FIG. 1.

With particular reference now to FIG. 2, it can be seen that the second diecutting roll 36 also has elliptical die formations thereon, each being similarly comprised of two U-shaped elements 52. The ends thereof are also spaced from one another, providing points 54 of discontinuity however at the top and bottom (i.e., circumferentially spaced locations), rather than at the sides. It can also be seen that the roll body 38 has a circumferential groove 56 formed into it in alignment with the discontinuities 54 of each die formation, which extends entirely around the body and leads into and from the cavity 58 formed within the elements 52 thereof.

Continuous-length web stock, generally designated by the numeral 60, travels through the cutting station in the direction indicated by the arrow in FIG. 1. In passing between the upstream pair of rolls (i.e., diecutting roll 10 and its associated anvil roll 26), U-shaped cuts 62 are made in the web 60, corresponding to the configurations of the die elements 48. Because of the discontinuities therein at 50, however, uncut connecting portions 64 remain between the main body 68 of the web and the ultimate scrap pieces 70, which securely retain the scrap and cause it to be carried by the web to the downstream pair of rolls 36, 26.

There, the elements 52 on the roll 36 cut the remainder of the rounded cruciform opening 72 into the web 60, producing correspondingly shaped scrap pieces 74. Although larger in the circumferential direction than the die formation (note the phantom line representation of FIG. 2), the scrap pieces 74 will nevertheless have a tendency to lodge within the cavity or space defined within the elements 52; the scraper device, generally designated by the numeral 76, serves to mechanically remove them.

As can best be seen in FIG. 2, the device 76 consists of a bracket piece comprised of a supporting bar 78, and mounting arms 80 extending perpendicularly from the opposite ends of the bar 78. The bracket spans the cutting station, and is secured to the frame 24 by the C-shaped clamp, generally designated by the numeral 82. The clamp has a slot 84 in its back portion 86 through which one of the arms 80 extends; the assembly is secured simply by tightening the thumb screw 88 upon the outside of the frame 24, thereby clamping the engaged arm 80 against the opposite surface.

The supporting bar 78 of the bracket has a slot 89 extending along its length, in which two scraping members, generally designated 90, are mounted. Each member 90 consists of a threaded shank member 92, from the inner end of which extends a relatively fine wire finger element 94; the shank members 92 are affixed at desired locations along the length of the slot 89 by use of pairs of nuts 96 (only the outer ones of which are visible), which are threaded (with interposed, unnumbered washers) upon the opposite ends of the members 92 and tightened against the bar 78. Thus, the members 90 can be positioned optimally to align the finger elements 94 with the circumferential grooves 56, and to ride therewithin as the roll 36 rotates in the press.

The groove 56 associated with each die formation serves to guide the aligned finger element 94 into and from the die cavity 58, and to prevent any displacement that might otherwise occur due to movement of the roll and/or vibration of the press. The discontinuities 54 permit the finger element 94 to pass through the circumscribed space 58, to effectively dislodge any scrap piece 74 held therein by the cutting elements 52.

Figure 3:
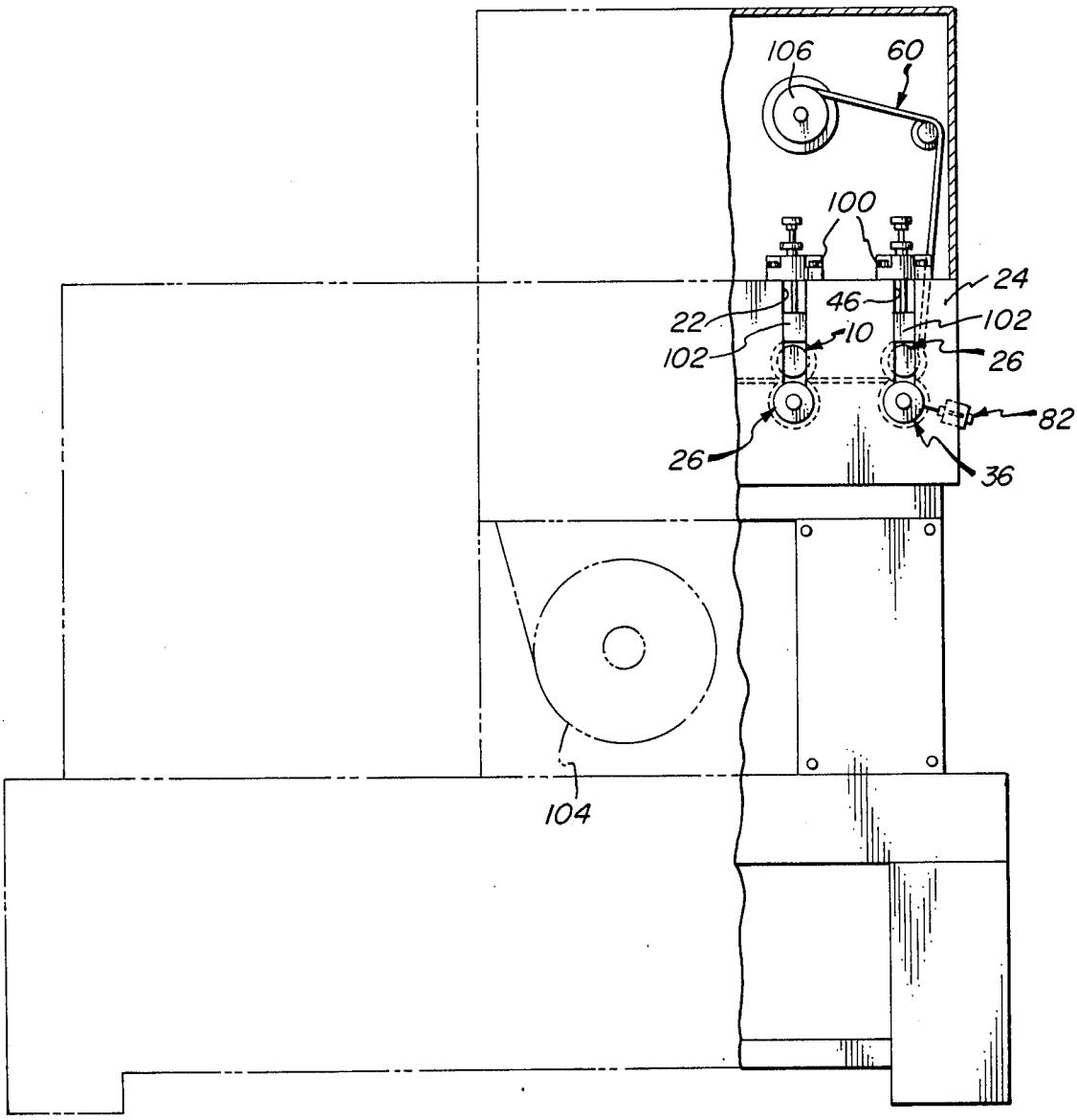
FIG. 3 is a schematic illustration of a diecutting press embodying the present invention, portions of which are shown in section and in phantom line.

FIG. 3 shows a rotary diecutting (and printing) press embodying the invention, wherein the cutting station includes, in addition to the rolls 10, 26, 36, a hold-down system consisting of a pressure bridge assembly 100 and an assist adaptor 102. These devices constitute no part of the present invention, and are now well-known in the art. Suffice to say that the assist adaptor is mounted above the upper of the two rolls constituting each diecutting/anvil roll pair, and that the bridge assembly is bolted thereover, in a position spanning the frame portions 24; the adaptor bears upon the upper roll, and the bridge assembly enables a controlled amount of force to be applied thereto. The web of material 60 to be cut is withdrawn from a supply roll 104, and the cut work is wound upon a take-up spool 106.

Although not shown, the press will normally include mechanical or pneumatic means for stripping from the web the scrap pieces that are not withdrawn through engagement within the second roll die formations. Also, suitable means for collecting the scrap pieces, once they are removed from the roll die formations and separated from the web, will be included at an appropriate location.

As will be appreciated by those skilled in the art, a considerable amount of variation can be made in the system and press described without departing from the scope of the invention. For example, rather than disposing the two cutting rolls in a linear relationship to one another, each with its own associated anvil roll, they may be disposed in a circumferentially spaced relationship about a common anvil roll. Indeed, such an arrangement may offer substantial benefits, such as by minimizing space requirements and by facilitating registration (i.e., alignment and timed operation) of the cutting dies. In some instances, it might be desirable to employ a third cutting roll, and this will also be within the present concept, provided the cutting elements are so configured that the potential scrap pieces are retained with the main body of the web stock until the final cutting step is performed.

As is standard practice, the diecutting rolls will normally be constructed to produce several identical scores upon each rotation, by providing multiple die formations at spaced locations about its outer surface. The formations may be aligned axially, as shown in the figures, and/or they may be at locations spaced about the circumference of the body.

It will of course be evident that the specific configuration of the opening to be cut in the web may take many different forms. As one alternative to the elliptical configuration illustrated, each die formation may consist of two reversely directed U-shaped elements (i.e., disposed with their curved portions closest), with those of the downstream roll being perpendicularly oriented relative to those of the upstream roll. The registered coaction of such a set of dies will produce a diamond shaped opening in the web, as may serve to define rounded corners for four tags or labels that intersect (as preforms) in the web.

As discussed above, it will in all cases be necessary that, following the initial cutting step, a connecting element remain to retain the potential strap piece with the rest of the web stock, for which purpose the die formation on the first roll must be discontinuous, at least at some point. The die formation of the second roll must also be discontinuous, the breaks in that instance necesssarily being located at two points spaced from one another in circumferential alignment on the surface of the roll; otherwise, the stationary mechanical scraping element could not pass freely through the space defined therewithin. The areas of discontinuity may be more extensive than indicated, as long as the dies, acting in tandem, cumulatively produce a complete score defining the opening that is to be cut.

As to the scraping device, it will normally be desirable to adjustably mount the functional parts, not only to enable precise alignment with the dies but also to permit use of the same device for a variety of cutting rolls. Finger components made of resilient wire have proven to be highly effective, and the assembly shown is particularly desirable from the standpoint of simplicity and economy. However, units of different design may of course be substituted, such as may employ scraping blades (aligned with the guide grooves) rather than wire fingers.

The circumferential grooves formed into the surface of the last roll are highly advantageous from the standpoint of guiding the scraping element, particularly to prevent damage from impact upon the cutting edge of the die, or faulty operation. However, it may not be necessary to employ such guide channels in all instances, such as if the scraping element and the mounting means provide sufficient rigidity and stability for effective and reliable operation.

Thus it can be seen that the present invention provides a novel system of tandem diecutting rolls for producing openings in traveling web stock, in which disposal of the scrap generated is achieved in a highly effective and efficient manner. More particularly, the scrap is mechanically removed from the die formations of the final cutting roll, positively and with a high degree of reliability. The invention also provides a novel diecutting press and a novel method incorporating the tandem roll system and the mode of operation that it affords, and the system, press and method of the invention are relatively uncomplicated, economical, and facile to use and to carry out.

Having thus described the invention, what is claimed is:

1. A system for cutting openings in a traveling web, and for facilitating the disposal of scrap pieces severed therefrom, comprising, in combination: first and second diecutting rolls adapted for journaling in a diecutting press; and a scraper member adapted for mounting thereon, each of said rolls having at least one raised cutting element on the outer surface thereof, with said cutting elements of said two rolls being configured for coaction to provide a functionally continuous edge configuration for cutting a scrap piece from the web by acting sequentially thereupon when said rolls are operated in tandem and in proper registry with one another, said cutting element of said second roll defining a circumscribed space within which the cut scrap piece will tend to lodge, and being discontinuous at least at two opposing points aligned circumferentially on said roll, said cutting element of said first roll being configured to precut the web at locations corresponding to said points of discontinuity of said second roll cutting element, and being discontinuous at least at one point which is displaced, with respect to said functionally continuous edge configuration, from said points of discontinuity of said second roll cutting element to leave a connecting web element for subsequent cutting by said cutting element of said second roll, said scraper member having an end portion which is constructed to follow said surface of said second roll and to pass through said points of discontinuity and said circumscribed space of said cutting element thereof, whereby said rolls can be mounted in tandem on a press and caused to operate sequentially upon a web traveling therethrough, to cooperatively cut a scrap piece therefrom and to thereby produce an opening therein, and whereby said scraper member can be mounted adjacent said second roll with said end portion disposed against said surface and in alignment with said discontinuities of said cutting element thereof, to pass through said circumscribed space during rotation of said roll and to thereby dislodge any scrap piece held therewithin.

2. The system of claim 1 wherein said second diecutting roll has a circumferential groove formed in said surface and aligned with said discontinuities of said cutting element thereof, said groove being adapted to engage said end portion of said scraper member against lateral displacement, and to guide said portion to and from said circumscribed space within said cutting element during rotation of said roll.

3. The system of claim 1 wherein both said first and second diecutting rolls have second said raised cutting elements on said outer surfaces and spaced axially from said one cutting elements, thereof said second cutting elements being disposed and configured for coaction to provide a second said functionally continuous edge configuration, to adapt said system to cut two openings in the web at transversely spaced locations thereacross.

4. The system of claim 1 wherein said cutting elements of both of said rolls define die formations of oblong configuration with said points of discontinuity therein, the axis of elongation of said formation of one of said rolls being perpendicular to that of the other, and said functionally continuous edge configuration being substantially cruciform.

5. The system of claim 4 wherein each of said formations is of substantially elliptical configuration, wherein said first roll formation has two points of discontinuity, and wherein said points of discontinuity of said formations of both of said rolls are disposed on the minor axes of the ellipses.

6. The system of claim 1 wherein said scraper member comprises: an elongated mounting bracket adapted for attachment to the press to extend parallel to the axis of rotation of said second roll, and having means thereon for adjustably affixing a scraper piece at each of a multiplicity of locations along the length thereof to act upon said second roll at corresponding locations along its length; and a scraper piece affixed to said bracket and including a finger projecting therefrom and providing said end portion of said scraper member.

7. A press having a station at which openings can be cut in a web traveling therethrough, comprising:

(1) a press frame;

(2) a diecutting station including:

a. a first diecutting roll journaled in said frame;

b. a second diecutting roll journaled in said frame in tandem relationship to said first roll; and c. at least one anvil roll journaled in said frame for cooperation with said diecutting rolls for cutting of a web material passing therebetween;

(3) a scraper member mounted in said frame adjacent said second diecutting roll;

(4) means for continuously feeding web material through said diecutting station to proceed from said first to said second diecutting roll; and (5) means for synchronously driving said rolls with the cutting elements thereof in registry with one another;

each of said rolls having at least one raised cutting element on the outer surface thereof, with said cutting elements of said two rolls being configured for coaction to provide a functionally continuous edge configuration for cutting a scrap piece from the web by acting sequentially thereupon when said rolls are in proper registry with one another, said cutting element of said second roll defining a circumscribed space within which the cut scrap piece will tend to lodge, and being discontinuous at least at two opposing points aligned circumferentially on said roll, said cutting element of said first roll being configured to precut the web at locations corresponding to said points of discontinuity of said second roll cutting element, and being discontinuous at least at one point which is displaced, with regard to said functionally continuous edge configuration, from said points of discontinuity of said second roll cutting element, for leaving a connecting element in the web for subsequent cutting by said cutting element of said second roll, said scraper member having an end portion which is constructed to follow said surface of said second roll and to pass through said points of discontinuity and said circumscribed space of said cutting element thereof, whereby said rolls can be caused to operate sequentially upon a web traveling through said press to cooperatively cut a scrap piece therefrom and to thereby produce an opening therein, and whereby said end portion of said scraper member can be disposed against said surface and in alignment with said discontinuities of said cutting element thereof, to pass through said circumscribed space during rotation of said roll and to thereby dislodge any scrap piece held therewithin.

8. The press of claim 7 wherein said press includes a second said anvil roll, said first diecutting roll being cooperatively paired with said one anvil roll at a first location of said station, and said second diecutting roll being cooperatively paired with said second anvil roll at a second location of said station downstream from said first location along the path of movement of the web material.

9. In a method for cutting openings in a traveling web, and for facilitating disposal of scrap pieces severed therefrom, the steps comprising:

a. transporting a web of material continuously through a cutting station comprised of first and second diecutting rolls, each of said rolls having at least one raised cutting element on the outer surface thereof, with said cutting elements of said two rolls being configured for coaction to provide a functionally continuous edge configuration for cutting a scrap piece from the web by acting sequentially thereupon when said rolls are in proper registry with one another, said cutting element of said second roll defining a circumscribed space within which the cut scrap piece will tend to lodge, and being discontinuous at least at two opposing points aligned circumferentially on said roll, said cutting element of said first roll being configured to precut the web at locations corresponding to said points of discontinuity of said second roll cutting element, and being discontinuous at least at one point which is displaced, with regard to said functionally continuous edge configuration, from points of discontinuity of said second roll cutting element, to leave a connecting element in the web for subsequent cutting by said element of said second roll;

b. causing said cutting rolls to rotate synchronously, with the cutting elements thereof in registry with one another, to act sequentially upon said web to cooperatively sever a scrap piece therefrom and to cut an opening therein, said first roll precutting said web at said corresponding locations of discontinuity of said second roll cutting element, and leaving a web element connecting the potential scrap piece to the remainder of said web, and said second roll cutting said connecting web element left by said first roll and thereby completing the severance of said scrap piece from said web; and c. passing an end portion of a scraper member disposed adjacent said second roll through said points of discontinuity and said circumscribed space of said cutting element thereof, to dislodge any scrap piece held therewithin.

10. The method of claim 9 wherein said second roll has a circumferential groove formed in said surface aligned with said discontinuities of said cutting element thereof, and wherein said end portion of said scraper member is urged into said groove to cause said groove to quide said end portion to and from said circumscribed space of said cutting element.

* * * * *